US005818036A

United States Patent [19]

Daly

[11] Patent Number: 5,818,036

[45] Date of Patent: Oct. 6, 1998

[54] LASER AIDED PRACTICE PUTTING DEVICE AND METHOD

[76] Inventor: John Daly, 1322 Elysium Blvd., Mount Dora, Fla. 32757

[21] Appl. No.: 805,047

[22] Filed: Feb. 24, 1997

Related U.S. Application Data

[60] Provisional application No. 60/013,114 Mar. 11, 1996.

[51] Int. Cl.[6] ..... A63B 69/36

[52] U.S. Cl. ..... 250/216; 473/150; 473/151; 473/218; 473/220

[58] Field of Search ..... 250/221, 222.1, 250/216; 473/150, 151, 152, 153, 154, 155, 157, 180, 190, 192, 218, 220, 221, 222, 225, 266, 267; 362/187, 206, 259

[56] References Cited

U.S. PATENT DOCUMENTS

| | | | |
|---|---|---|---|
| 4,997,189 | 3/1991 | Perkins | 473/221 |
| 5,029,868 | 7/1991 | Cloud | 473/220 |
| 5,330,188 | 7/1994 | Reimers | 473/151 |
| 5,343,376 | 8/1994 | Huang | 362/259 |
| 5,388,831 | 2/1995 | Quadri et al. | 473/220 |
| 5,435,562 | 7/1995 | Stock et al. | 473/220 |
| 5,450,148 | 9/1995 | Shu et al. | 362/259 |
| 5,452,897 | 9/1995 | Mick | 473/409 |
| 5,465,972 | 11/1995 | Cornett | 473/220 |
| 5,472,204 | 12/1995 | English et al. | 473/220 |
| 5,527,041 | 6/1996 | Terry, III et al. | 473/150 |
| 5,663,828 | 9/1997 | Knowles et al. | 359/237 |

*Primary Examiner*—Edward P. Westin
*Assistant Examiner*—John R. Lee
*Attorney, Agent, or Firm*—Charles M. Kaplan

[57] ABSTRACT

Apparatus and methods for practicing golf involve the use of a projected laser light beam that acts as a fixed guide to the hole or target.

20 Claims, 7 Drawing Sheets

LASER AIDED PRACTICE PUTTING DEVICE AND METHOD

BACKGROUND OF THE INVENTION

This invention relates to golf practice devices and more particularly to a visible laser aided golf practice putting cup. Prior art has disclosed practice putting devices that use a laser aiming device attached to a putter. Connecting a laser light transmitter to a putter or other golf club changes the feel and balance of the club or putter and also interferes with the golfer's putting stroke or swing. This invention has incorporated a visible laser beam emitter into a practice putting device which projects a bright line on the putting surface from the center of the hole to the putter. By employing optical components the normal beam qualities of the laser have been transformed into a well-defined line.

OBJECTIVES OF THE INVENTION

Accordingly, it is an object of this invention to provide improved golf practice and training devices and methods.

Another object is to provide golf training or practice devices and methods that produce a visible line that extends from the center of the hole to the golfer without interfering with the golfer's stroke or swing.

Another object is to provide devices and methods that will improve a golfer's alignment to the hole or to a practice putting cup.

Still another object is to provide a laser light golf practice training and practice device in which the width and length of the laser light beam can be adjusted to the environment in which the device is used.

Another object is to provide means for enhancing the display of an alignment laser light beam on the top of a putter that does not interfere with the putting stroke.

A further object is to provide exact on-line position feedback to the golfer as the ball is struck and as it travels towards the cup.

Another object is to illustrate the alignment of the putter head at address prior to stroking and during execution of the putting stroke while hitting the golf ball.

Another object is to provide golfers with means and methods for confirming correct alignment of their club or putter with a target hole during address.

Another object is to enable a golfer to monitor club head position during execution of a putting or other stroke.

A further object is to provide a golf training and practice device with a removable laser pointer so that the laser emitter can also be used for as a pointer for lectures, demonstrations, or as an attention getter.

An additional object is to use a laser light beam to provide a fixed unmoving target line along the ground or a rug that acts as a guide and a reference line to the hole or cup, Another object is to provide golf practice and training cups that are easy to set up, adjust and maintain, durable, relatively inexpensive, accurate, fun to use by golfers of any skill level, and which do not possess defects found in similar prior art golf equipment.

Other objects and advantages of the golfing methods and devices incorporating this invention will be found in the specification and claims and the scope of the invention will be set forth in the claims.

DESCRIPTION OF THE INVENTION

Figure 1:
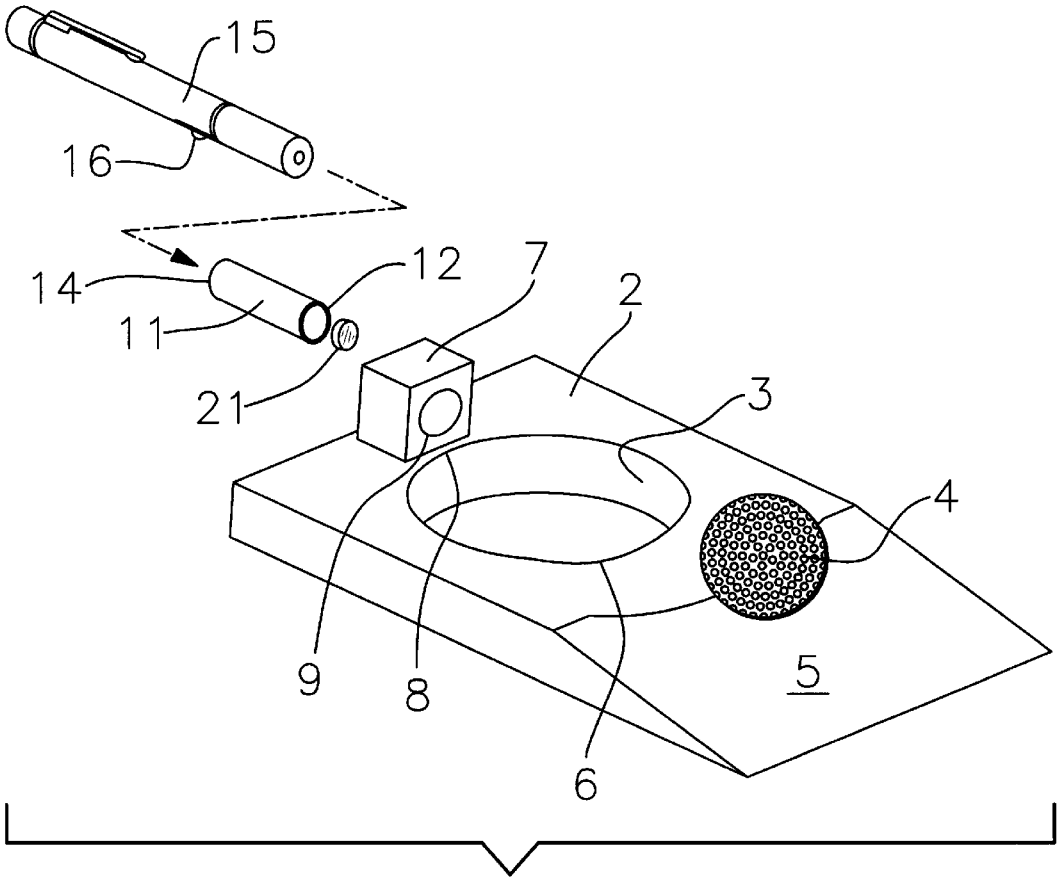
FIG. 1 is a perspective exploded view of an embodiment of this invention.
Figure 2:
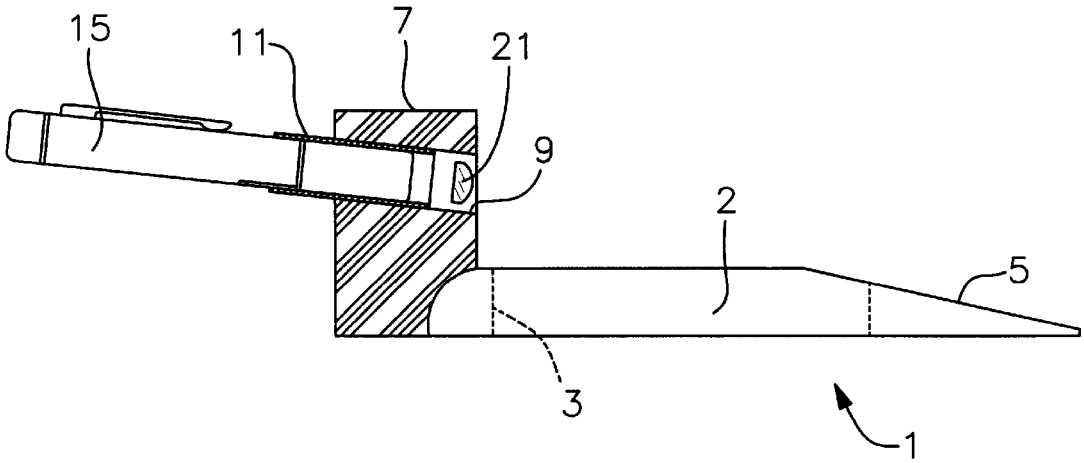
FIG. 2 is a partially cross sectional side view of the assembled embodiment of FIG. 1.
Figure 5:
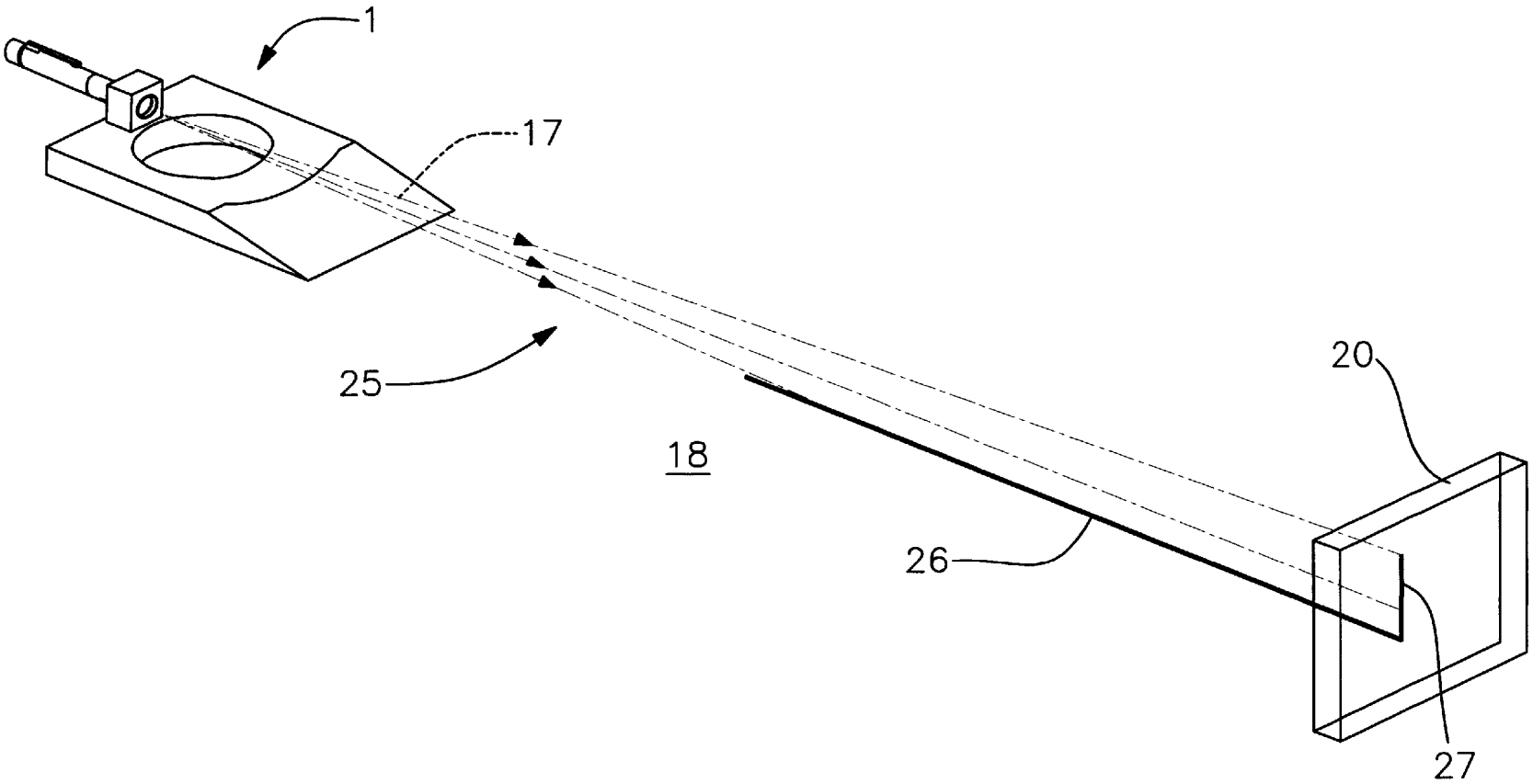
FIG. 5 is a schematic perspective view of a putting cup showing a laser beam in accord with this invention.

FIGS. 1, 2 and 5 show a laser putting cup 1 in accord with this invention. The putting cup 1 has main body member 2 which defines a central circular golf hole 3 into which a golf ball 4 is to be rolled up from a slanted ramp 5 by a putter or otherwise propelled by another type of golf club. The hole 3 has a 4.25 inch diameter, which is consistent with the official rules of golf, and an entrance side 6 at which golf balls are aimed and putted. Support bracket means, such as mounting fixture 7, is attached to body member 2 adjacent the back or opposite side 8 of hole 3. A circular opening or bore 9 extends completely through fixture 7, and bore 9 is centered adjacent side 8 essentially diametrically opposite to the center of hole entrance side 6. Bore 9 may have a diameter of five-eights inch, and the bore is angled downwardly at a small angle, such as 1.5 degrees. Fixture 7 may be either an integral or molded part of body member 2 or may be a separate part attached to the cup body member, which may be made from metal, plastic or wood.

A right circular cylindrical tube 11 has one end 12 that extends into bore 9 where the tube is firmly secured to fixture 7. An opposite end 14 of tube 11 protrudes from fixture 7. Means for producing a visible beam of laser light, such as a handheld laser pointer 15, is insertable into and removable from end 14 of the tube. Tube 11 is dimensioned such that slipping the laser pointer 15 into an interference fit with the tube diameter positions the laser on-axis for correct beam projection, and also this serves to actuate an on-off switch 16 which is depressed inwardly by the inside surface of the tube. Activation of the laser projects a beam 17 of laser light diametrically across the center of hole 3 on to and across an adjacent surface 18, such as a rug or putting green. Pointer 15 is rotatable within tube 11.

The laser beam can have any visible wavelength. For example, a 650 nm wavelength, 5 mW laser diode device would be very bright and would conform to FDA approved standards for a Class Illa laser. Such a laser is commercially available as the HL 106 laser pointer, which is powered by two small N-type 1.5 V batteries. Tube 11 should be a non-abrasive plastic, such as nylon or delrin, to avoid scratching the laser pointer 15.

Figure 3:
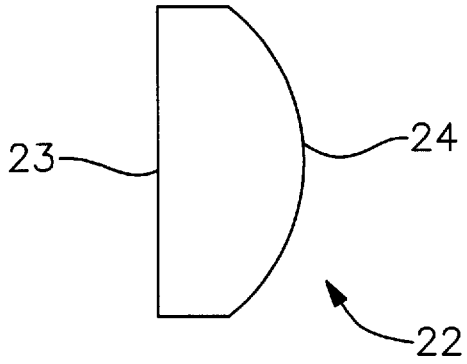
FIG. 3 is an enlarged side view of another embodiment of a cylindrical lens in accord with this invention.
Figure 4:
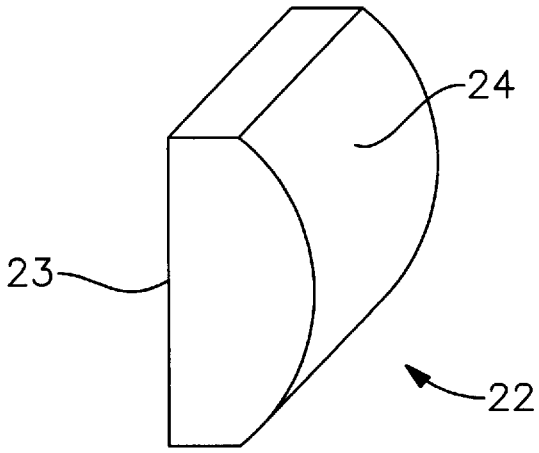
FIG. 4 is a perspective view of the lens shown in FIG. 3.

The width of the laser light beam 17 should be adjustable to enhance or maximize the size or length of the beam that is visible on the surface 18 and on a wall 20 or the face or top of a putter or other type of golf club. The means for changing the width of the beam 17 may include means that can diffuse the beam, such as a lens 21 that has been fixedly attached inside of tube 11 adjacent end 12. Lens 21 may be a section of a right circular cylinder that is shaped like a circular disk, as shown in FIGS. 1 and 2. Or the lens may have other shapes, such as the rectangular shape of lens 22 shown in FIGS. 3 and 4. The beam 17 of laser light could be diffused by passing it first through either the flat side 23 or the curved side 24. Or the sides 23 and 24 of the lens could both be curved, and the curves could be either convex or concave, or a mixture concave and convex sides could be used. The width of beam 17 may also be changed by diffusing the beam with a cylindrical mirror, as for example by silvering the side 24 of lens 22 and orienting the laser pointer 15 so that the beam reflects from side 24 at an angle, such as forty-five degrees, and the beam 17 would then be then projected as shown.

The geometry of the projected beam 17 is shown in FIG. 5 where a laser pointer 15 is inserted into the fixture 7 of a putting cup 1 as described above. The vertical line 25 projected by the laser because of the cylindrical lens 21 is projected on the putting surface or floor 18 as a long straight fixed unmoving line 26. The length of this line is dependent upon the focal length of the cylindrical lens 21, the angle that the laser pointer 15 is tilted with respect to the floor or surface 18, and height of the laser above the surface 18. It has been found that with a 2 inch focal length cylindrical lens 21, a 1.5 degree tilt, and the laser beam 2.0 inches above the surface 18, the resulting laser line 26 will be projected for approximately 20 feet. The orientation of the cylindrical lens is positioned for refraction the beam in the vertical axis. The inherent asymmetry of laser diode output beam cross-section can be manifested in line length and width adjustment by rotating the laser pointer 15 within the tube 11 relative to the cylindrical lens 21. Other combinations of the lens focal length, laser tilt, and laser beam height can be used to obtain similar results. The length of the laser line should remain somewhat less than 20 feet to maintain brightness and therefore maximum visibility by the golfer.

Figure 6:
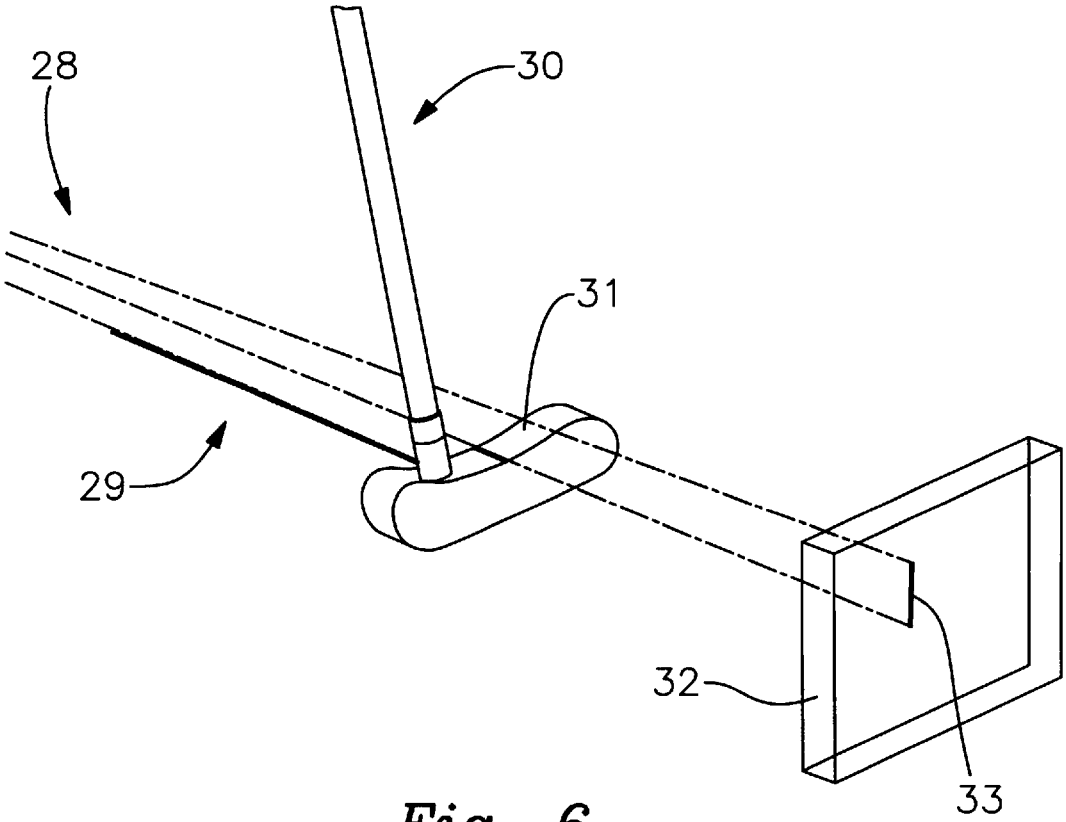
FIG. 6 is a perspective view of the projected beam of FIG. 5 with a putter in position.

FIG. 5 shows that the projected vertical laser light beam 25 propagates to a segment of a wall 20 and is observed on surfaces that reflect the laser light from the floor as a line 26 and from the wall as a vertical line 27. FIG. 6 shows a similar laser beam 28 from the cup 1 with its projected line 29 on the floor with a golf putter club 30 in position to practice putting. When the golfer places the putter blade 31 on top of the line 29, the laser beam is projected in a straight line 31 on the top of the putter blade. The placement of the putter obstructs the previous beam projection on the wall and behind the putter head with the non-obstructed portion of the laser beam on the wall 32 projected as a line 33. After the putter has been properly aligned by reference to the laser beam line 29, a ball can be placed on the line 29 between the putter 31 and the hole 3 in a practice cup 1.

Figure 7:
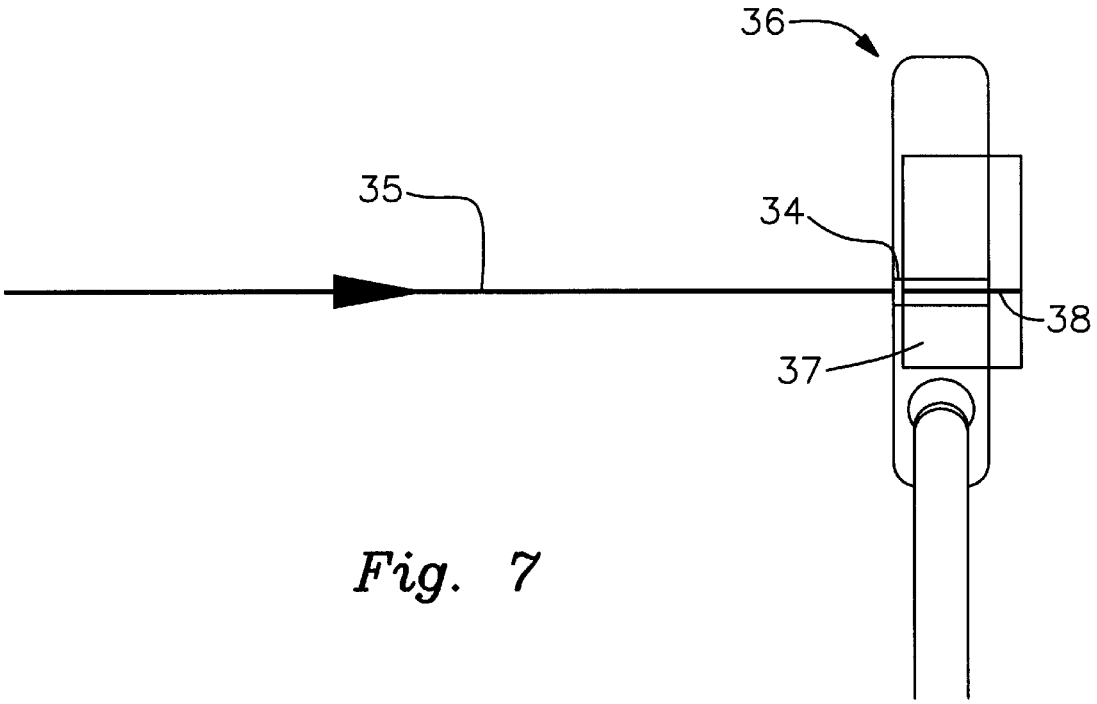
FIG. 7 is a top plan view of another embodiment of the invention.

The golfer can then practice his putting stroke knowing the exact line or path to the cup/hole or target. Stroking the ball along the laser beam line can be observed to monitor proper direction of the ball on its route to the hole. This exact ball position relative to the laser beam line throughout its travel to the hole provides insight into correct putting. The golfer can also monitor his putter head alignment prior to stroking. This is displayed in FIG. 6 where the projected laser beam line on top of the putter head should be normal to the putter face. Most putter heads include an alignment line 34, as shown in FIG. 7, which alignment line is perpendicular to the putter club face and therefore parallel to the correct alignment. Proper putter club head alignment at address will show that the putter head alignment line 34 on top of the putter head is parallel to the projected laser beam 35.

To enhance the display of this projected laser beam 35 on top of the putter head 36, FIG. 7 shows an attachment 37 to the top of the putter club head. In this embodiment, a ½ inch thick optically clear plastic (e.g. acrylic) plate 37 functions as the laser beam display medium attachment. This optical plastic typically includes adequate bulk imperfections that scattered the laser beam clearly displaying the path of the laser beam as a line 38 through the clear window-like material. This clear material not only displays the correct alignment to the putting target or hole but it allows clear visibility of the top of the putter. This offers minimum disturbance to the golfer and an unobstructed view of the putter club head alignment mark 34. The golfer can then verify alignment of his putter head to the laser illuminated target path 35. This alignment is visible not only during address but also during the actual putting stroke.

Figure 8:
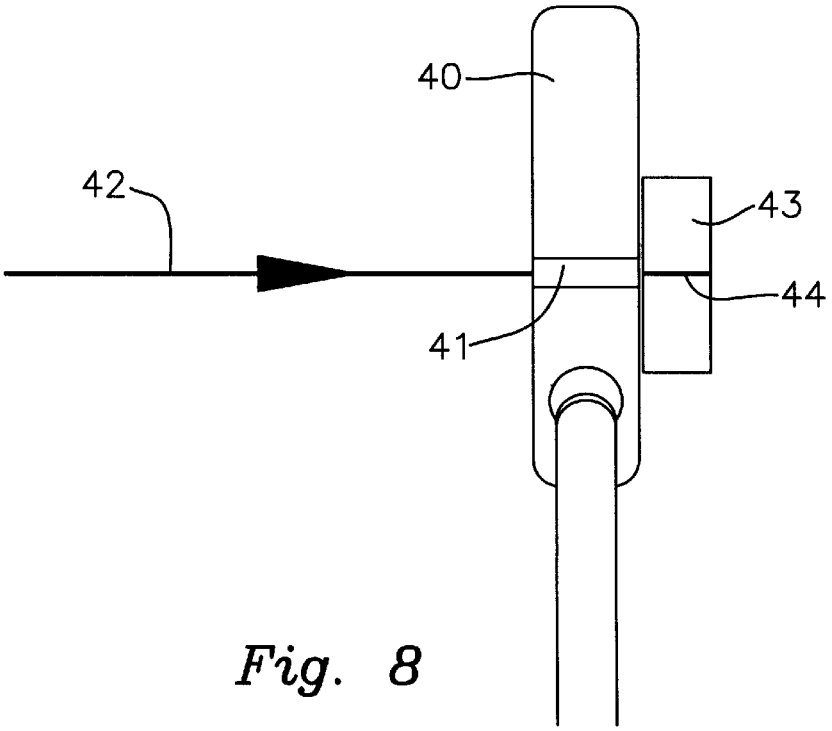
FIG. 8 is a top plan view of another embodiment of the invention.
Figure 9:
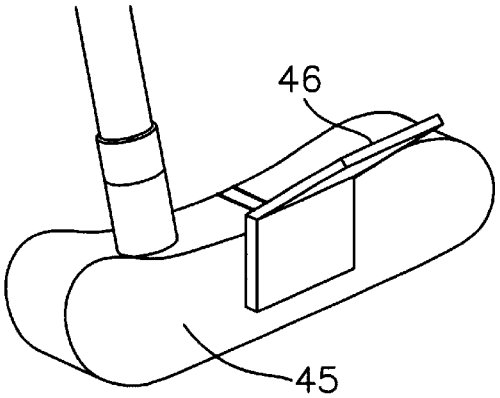
FIG. 9 is an isometric view of another embodiment of the invention.

The putter alignment display device can assume several geometries. The objective is to clearly display the laser beam on top of the putter. The embodiment shown in FIG. 7 is a clear plastic rectangle which can be attached to the top of the putter head. Another embodiment, as shown in FIG. 8, has a putter head 40 and its alignment markings 41 with the projected laser beam 42 with a folded piece of thin plastic or paper sheet 43 connected to the back side of the putter head. This clearly displays the laser beam segment 44 aligned relative to the putter head marking 41. FIG. 9 shows another embodiment in which a putter head 45 has a clear plastic angled attachment 46 attached to the backside of the putter. The display enhancers 37, 43 and 46 are sufficiently light that they do not interfere with golfer's putting stroke or with the feel or balance of the putters to which they are attached.

Figure 10:
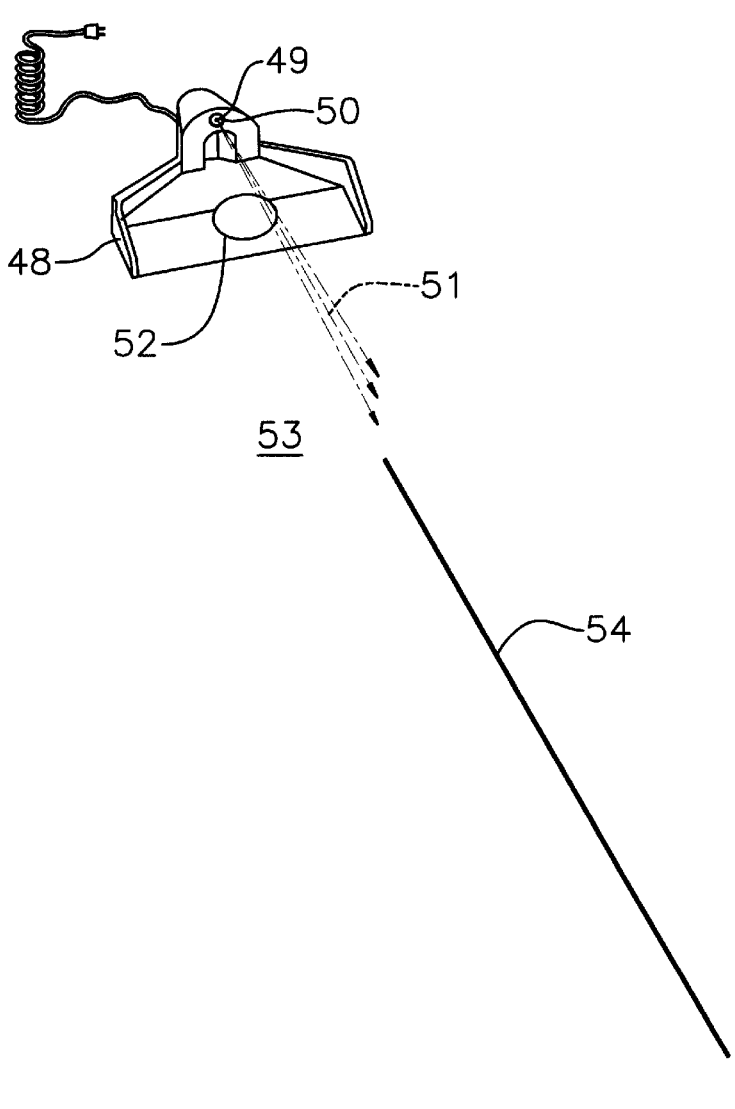
FIG. 10 is a schematic isometric view of another embodiment of the invention.

FIG. 10 shows another embodiment in which a conventional electrically operated automatic ball return putting cup 48 has been equipped with a laser beam emitter 49 and lens 50. The emitter 49 may be an inserted laser pointer 15, as described above, or emitter 49 may be a dedicated permanent laser diode beam emitter that operates off of the AC power supply for the ball return apparatus in cup 48 that has been adjusted by a transformer to the voltage required to produce a visible light beam 51. The angle and location of the emitter 49 and lens 50 are oriented as described for the above embodiments with reference to the center of the hole 52 and the putting surface 53 so that a line 54 of visible laser light extends diametrically across the center of the hole along the putting surface 53 away from the center of the hole.

It has thus been shown that the laser employed to practice the methods of this invention can be a visible laser diode emitter which is inexpensive and is powered by small batteries. A commonly available suitable laser product is the shirt pocket laser pointer which typically resembles a writing pen. This invention accommodates a laser pointer 15 which can be inserted into the putting cup 1 as the laser source. Permanent installation on cup 48 of a dedicated laser diode that operates off of the cup power supply is another equally valid approach. Projection of the laser line, such as 35, over an alignment line on the top of the putter head provides confirmation of proper club alignment. The addition of a plastic laser line display device, such as 37, 43 or 46, which can be attached to the putter, enhances the alignment display but does not interfere with the putting stroke. When not being used during a practice putting session, the pointer 15 can be removed and used as a conventional laser pointer. The dual use of the laser pointer is a convenience and a practical result of the manner in which it is used to practice this invention.

While the present invention has been described with reference to particular embodiments and methods, it is not intended to illustrate or describe all of the equivalent forms or ramifications thereof. Also, the words used are words of description rather than limitation, and various changes may be made without departing from the spirit or scope of the invention disclosed herein. It is intended that the appended claim cover all such changes as fall within the true spirit and scope of the invention.

I claim:

1. A golf practice cup comprising:

a flat solid portable body having a circular hole therein for receiving a golf ball that has rolled across a surface upon which said body is supported, said body having a slanted hole entrance ramp over which said ball may be propelled into said hole;

a support bracket permanently attached to said body, said support bracket being located on said body adjacent a side of said hole that is generally diametrically opposite to said entrance ramp, said support bracket being aligned with the center of said hole, and said support bracket extending above said hole and said entrance ramp;

a laser pointer for producing a visible laser beam, said pointer being mounted in said support bracket on said side of said hole opposite to said entrance ramp, said laser pointer being aligned diametrically with said center of said hole; and means for projecting said laser beam from behind said hole essentially diametrically across said hole over its center and beyond said entrance ramp so as to provide a visible beam of light that intersects said surface and thereby provides a visible, fixed, unmoving line on said surface extending from essentially the center of said hole across said surface toward a golf ball, said beam being usable to intersect a golf club blade and extend across the golf club blade so as to enable a golfer to place the golf club blade directly on said visible line and thereby to align the golf club blade with said center of said hole and to propel a golf ball along said visible line across said surface toward the center of said hole.

2. The golf practice cup defined in claim 1, further comprising means for diffusing said laser beam.

3. The golf practice cup defined in claim 2, wherein the laser beam diffusing means comprises means for refracting said laser beam.

4. The golf practice cup defined in claim 2, wherein the laser beam diffusing means comprises means for reflecting said laser beam.

5. The golf practice cup defined in claim 2, further comprising lens means and means for passing said laser beam through said lens means.

6. The golf practice cup defined in claim 5, wherein said lens means has a cylindrical surface.

7. The golf practice cup defined in claim 1, further comprising means for changing the width of said laser beam.

8. The golf practice cup defined in claim 1, further comprising means non-reflective of laser light attached to said golf club blade for enhancing the display of said laser beam across said golf club blade.

9. The golf practice cup defined in claim 8, wherein said golf club is a putter blade and said means attached to said golf club blade comprises a clear plastic plate attached to the top of the putter blade.

10. The golf practice cup defined in claim 9, wherein said means attached to said putter blade comprises plate means attached to and extending behind the rear side of said putter blade.

11. The golf practice cup defined in claim 10, wherein said plate means extends at an angle that intersects the top of said putter blade.

12. A practice putting cup comprising:

a portable solid main body member having a central flat area defining a circular hole for receiving a putted golf ball, said main body member having a slanted entrance ramp at which a golf ball is aimed and putted across a surface upon which said main body member rests, the golf ball having to roll upwardly on said entrance ramp to reach said hole;

a mounting fixture permanently attached to said main body member adjacent a side of said hole that is generally diametrically opposite to said entrance ramp, said mounting fixture extending above said flat area of said main body member and having a circular opening there through, said circular opening being generally diametrically aligned with the center of said hole above said hole at a slightly downward angle to horizontal;

a generally cylindrical laser pointer extending at least partially into said circular opening and being movably supported by said mounting fixture, said laser pointer being removable from said circular opening and being usable as a pointer independently from said practice putting cup; and said laser pointer producing a visible laser beam that projects from behind said hole essentially diametrically across said hole and beyond said entrance ramp toward a golf ball so as to provide a visible, fixed, long, straight, unmoving line of laser light extending from essentially the center of said hole on to the surface across which a golf ball is putted, said line of laser light being usable to intersect a putter blade upper surface so as to enable a golfer to aim and putt a golf ball along said visible line on the surface across which the golf ball is putted toward the center of said hole.

13. The practice putting cup defined in claim 12, further comprising means in said circular opening for diffusing said laser beam.

14. The practice putting cup defined in claim 13, wherein the diffusing means in said circular opening comprises lens means.

15. The practice putting cup defined in claim 12, further comprising said mounting fixture being integral with said main body member, and a hollow cylindrical tube having one end extending into said circular opening and an opposite end protruding beyond said mounting fixture away from said hole, said laser pointer being received through said opposite end of said tube, and said laser pointer being rotatable within said tube.

16. The practice putting cup defined in claim 12, further comprising means attached to said putter blade for enhancing the display of said laser beam across the top of said putter blade, the laser beam enhancing means being non-reflective of said laser light.

17. The practice putting cup defined in claim 16, wherein said means attached to said putter blade comprises a clear plastic plate attached to the top of the putter blade, said putter blade being visible through said clear plastic plate.

18. The practice putting cup defined in claim 16, wherein said means attached to said putter blade comprises plate means attached to and extending behind the rear side of said putter blade.

19. The practice putting cup defined in claim 18, wherein said plate means extends at an angle that intersects the top of said putter blade.

20. The method of putting a golf ball across a surface toward the center of a circular hole, comprising the steps of:

projecting a visible laser beam from one side of said hole diametrically across said center of said hole and beyond the opposite side of said hole;

intersecting said laser beam with the surface across which said golf ball is putted on said opposite side of said hole;

adjusting the width of said laser beam by diffusing said laser beam so as to produce a fixed, unmoving, long, straight, visible line of laser light that contacts said surface and extends from the center of said hole toward a location where a golf ball is to be putted;

placing a putter blade on said line of laser light on said surface so as to intersect said beam and produce a visible line of light on the upper surface of said putter blade that extends from said putter blade on said surface between said putter blade and the center of said hole;

aligning the front face of said putter blade at essentially right angles to said line of laser light that extends on said surface between said putter blade and the center of said hole;

placing a golf ball on said line of laser light on said surface that extends between said golf club blade and said hole; and hitting said ball with said putter blade so as to putt said golf ball toward said hole on said surface along said line of laser light that extends on said surface between said putter blade and the center of said hole.

* * * * *